US007594636B2

(12) United States Patent
Wong

(10) Patent No.: US 7,594,636 B2
(45) Date of Patent: Sep. 29, 2009

(54) PICTURE FRAME POSITIONER

(76) Inventor: Hammond Wong, 2843 Trish Way, West Covina, CA (US) 92791

( * ) Notice: Subject to any disclaimer, the term of this patent is extended or adjusted under 35 U.S.C. 154(b) by 0 days.

(21) Appl. No.: 11/309,138

(22) Filed: Jun. 27, 2006

(65) Prior Publication Data

US 2007/0295879 A1 Dec. 27, 2007

(51) Int. Cl.
*A47G 1/16* (2006.01)

(52) U.S. Cl. ..... 248/497; 248/205.3; 248/215; 248/489

(58) Field of Classification Search ..... 248/215, 248/216.1, 205.3, 217.3, 683, 684, 488–490, 248/497–498, 475.1, 476, 495
See application file for complete search history.

(56) References Cited

U.S. PATENT DOCUMENTS

| | | | | |
|---|---|---|---|---|
| 2,492,411 | A | 12/1949 | Barnes et al. | 248/29 |
| 3,622,116 | A | 11/1971 | Fellows | 248/467 |
| 4,228,982 | A | 10/1980 | Sellera | 248/467 |
| 4,336,884 | A | 6/1982 | Hart et al. | 206/575 |
| 4,384,648 | A | 5/1983 | Hart et al. | 206/527 |
| 4,669,169 | A * | 6/1987 | Hogg | 29/432 |
| 5,433,416 | A | 7/1995 | Johnson | 248/475.1 |
| 5,507,464 | A * | 4/1996 | Hamerski et al. | 248/683 |
| 6,095,465 | A * | 8/2000 | Weck et al. | 248/205.3 |
| 6,206,334 | B1 * | 3/2001 | Weck et al. | 248/467 |
| 6,499,707 | B2 * | 12/2002 | Hamerski et al. | 248/205.3 |
| 2001/0028022 | A1 * | 10/2001 | Hamerski et al. | 248/205.3 |
| 2004/0084598 | A1 | 5/2004 | Dodig, Jr. | 248/475.1 |
| 2007/0075211 | A1 * | 4/2007 | Potter | 248/476 |
| 2007/0295879 | A1 * | 12/2007 | Wong | 248/475.1 |
| 2007/0295880 | A1 * | 12/2007 | Wong | 248/495 |

* cited by examiner

*Primary Examiner*—Amy J. Sterling
*Assistant Examiner*—Tan Le
(74) *Attorney, Agent, or Firm*—Walter J. Tencza, Jr.

(57) ABSTRACT

An apparatus including a J-shaped hanger and a first device is provided. The J-shaped hanger may include a hook and a base, the hook connected to the base, the base forming a substantially flat vertical portion of the J-shape, the hook forming the hook portion. The first device may have a first portion having an opening which is large enough so that the base can pass through the opening of the first portion while the base is substantially parallel to the first device. The first device has a front with a first temporary or removable adhesive and a back with a second temporary or removable adhesive. The apparatus can be used for hanging a picture frame.

15 Claims, 11 Drawing Sheets

PICTURE FRAME POSITIONER

FIELD OF THE INVENTION

This invention relates to improved methods and apparatus concerning picture frames.

BACKGROUND OF THE INVENTION

Individuals usually guess or make a rough estimate about where picture frames need to be hung. In order to make it right, the most common way is to measure the distance from the top of a ceiling to a top of the picture frame, and then the distance from the left to the right of the wall, and then to mark down the center point where the frame is about to be hung. Even after an individual has found the center point, there are still difficulties for the individual to hang the particular picture frame the precisely to the place they want. To get more precise measurement, they need to: (a) match the center point that they mark down on the wall to the center point of the frame; (b) calculate the exact distance from the top of the wire at the back of the frame to the top of the frame; (c) know the design of the metal hanger, the measurement from the top of the hanger to the hook; and (d) know the tension of the wire. Usually nails are applied on the wall along with metal hangers. However, the nails may be removed and reapplied repeatedly on the wall if the position of the frame is incorrect, causing physical damage to the wall. It's a tedious and time consuming process which requires professional skill to handle.

There are various devices known in the prior art for hanging picture frames. U.S. Pat. No. 4,336,884 to Hart et. al. discloses a picture frame hanging backing sheet 10. (Hart et. al, FIG. 1). The sheet 10 includes adhesive areas 44 for releasably adhering to a picture frame and adhesive areas 48 for releasably adhering to a wall. (Hart et. al, FIGS. 1 and 2). Hangers 12 are inserted into slots in the backing sheet 10. (Id.) In operation, the adhesive areas 44 are adhered to the back of a picture frame (with the hangers 12 inserted into the sheet 10), such that a wire 52 at the back of the frame is hung over the hangers 12 and is slightly tensioned. (Hart et. al, FIGS. 1 2, 4a, col. 5, Ins. 1-10). Next the adhesive areas 48 are pressed against a wall, and adhered to the wall, causing the sheet 10 to be adhered to the wall. Next the picture frame is removed from the sheet 10, by releasing the adhesive areas 44 from the picture frame and by removing the wire 52 from the hangers 12. With the sheet 10 adhered to the wall by adhesive areas 48, and the hangers 12 inserted into the sheet 10, the hangers 12 are fixed to the wall by, for example, hammering nails into the hangers 12. (Hart et. al., FIG. 4b). Each of the hangers 12 has a single opening for a nail. (Hart et. al., FIG. 1). Next, the sheet 10 is removed from the hangers 12, leaving the hangers 12 nailed into the wall. (Hart et al., FIG. 4c). The picture frame can then be hung by draping the wire 52 over the hangers 12.

U.S. Pat. No. 6,095,465 to Weck et. al. discloses a picture hanger member 12 with a triangular shaped base 14 and an opening 20. (Weck et. al., FIG. 1, col. 4, Ins. 60-65). A temporary adhesive 46 is attached to a hanger member 12. (Weck, FIG. 1). The hanger member 12 can be temporarily attached to a wall 34, by adhesive 46 and then moved if the hanger member 12 is not at the correct position. (Weck, col. 5, Ins. 48-60). The hanger member 12 includes three nail receiving guide holes 22 within three guides or protrusions 28. (Weck, FIG. 2). Nails can be driven through a shock absorbing layer 40 to fix the hanger member 12 to the wall 34. (Weck, Fig., col. 5 In. 48-col. 6, In. 56).

U.S. Pat. No. 3,622,116 to Fellows, discloses a tongue member 10 which is fixed to a picture frame 26 and then inserted into a bracket member 30 fixed to a supporting surface 32. (Fellows, FIGS. 1-8). U.S. Pat. No. 4,228,982 to Sellera discloses a wall pad 16 and a frame pad 22. (Sellera, col. 1, In. 50-col. 2, In. 30). The wall pad 16 and the frame pad 22 have adhesives which adhere to a wall and a back of a picture frame, respectively. (Id.). The frame pad 22 has a downward extension 82 which can be inserted into a pocket 53 of the wall pad 16 to hang a picture frame onto a wall. (Id.) U.S. Pat. No. 2,492,411 to Barnes provides a resilient member 29 which adheres to a wall and a picture frame to keep the frame straight. (Barnes, col. 2, In. 44-col. 3, In. 29). U.S. Patent Application No. US 2004/0084598 A1 to Dodig, J R. discloses a mounting carrier 22 having a pair of hooks 20. (Dodig, p 2, paragraph 19-paragraph 25). The carrier 22 is mounted on a wall 14 and thereafter a picture 12 is hung by a wire from 18 from the hooks 20. (Dodig, Id.).

SUMMARY OF THE INVENTION

One or more embodiments of the present invention provide a simple way to position and hang picture frames on a wall without professional skill. A picture frame can be aligned visually on a wall without precise measurements. A picture frame can be positioned and adjusted precisely before hardware is applied, eliminating unnecessary holes in walls.

The present invention in one embodiment provides an apparatus comprising a J-shaped hanger and a first device. The J-shaped hanger includes a hook and a base, the hook connected to the base, the base forming a substantially flat vertical portion of the J-shape, the hook forming the hook portion. The first device has a first portion having an opening which is large enough so that the base can pass through the opening of the first portion while the base is substantially parallel to the first device. The first device has a front with a first temporary or removable adhesive and a back with a second temporary or removable adhesive.

The base of the J-shaped hanger may include an opening. The first device may include a lower cap portion having a protrusion which can be inserted into the opening of the J-shaped hanger and which snaps into the opening of the base of the J-shaped hanger to hold the J-shaped hanger to the lower cap portion of the first device. The base of the J-shaped hanger may have attached thereto a plurality of protrusions each having an opening through which a nail can be driven.

The present invention in one embodiment includes a method comprised of pulling a wire of a picture frame up with a J-shaped hanger of an apparatus, and attaching the apparatus including the J-shaped hanger to a back of the picture frame, so that the wire is tensed. The apparatus may be configured as previously described. The method may further include detaching the J-shaped hanger from the rest of the apparatus, and attaching the second temporary adhesive to a wall to attach a first portion of the apparatus to the wall. The method may also include inserting the J-shaped hanger into the first portion of the apparatus and fastening the J-shaped hanger to the wall. In one embodiment any remaining portion of the apparatus may be detached from the wall, while leaving the J-shaped hanger fastened to the wall.

DETAILED DESCRIPTION OF THE DRAWINGS

Figure 1:
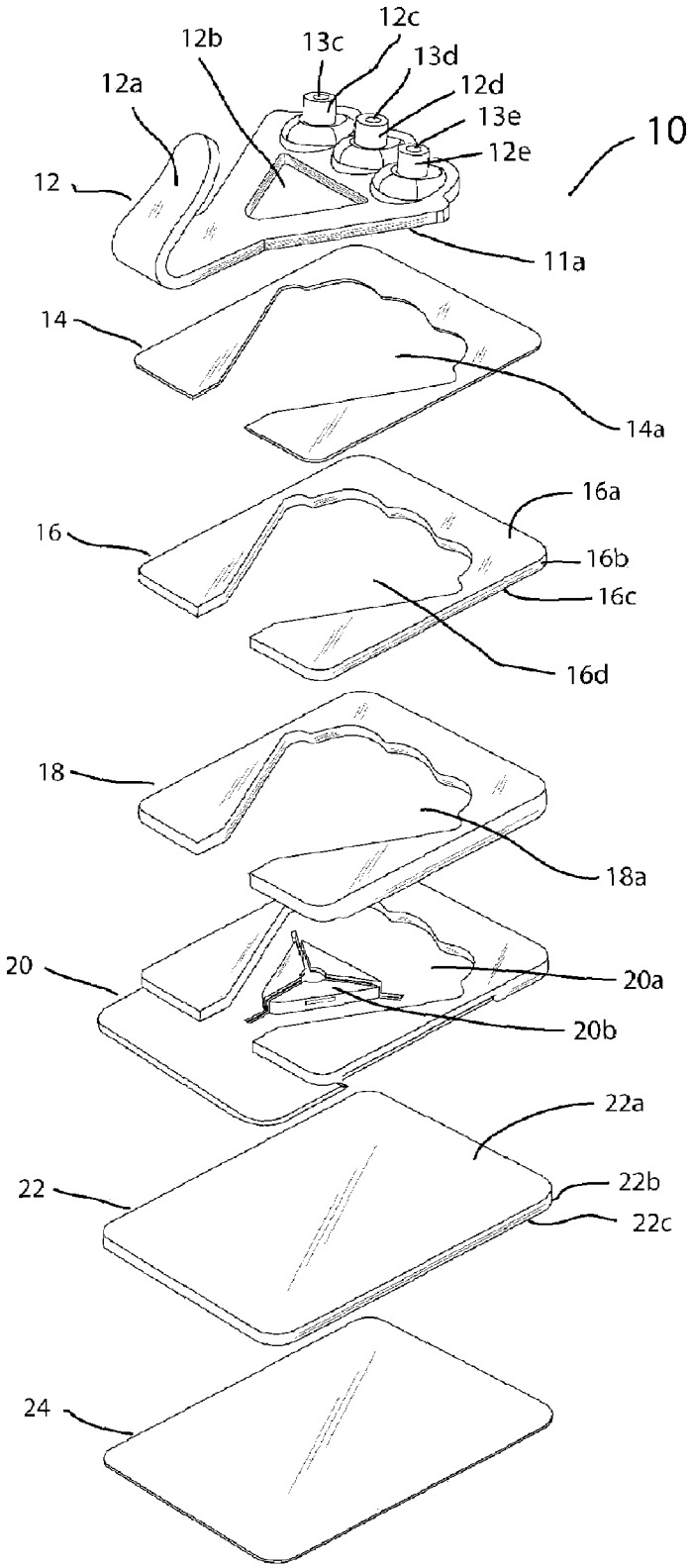
FIG. 1 shows a perspective view of an apparatus or positioner in accordance with an embodiment of the present invention with the apparatus shown taken apart.
Figure 2A:
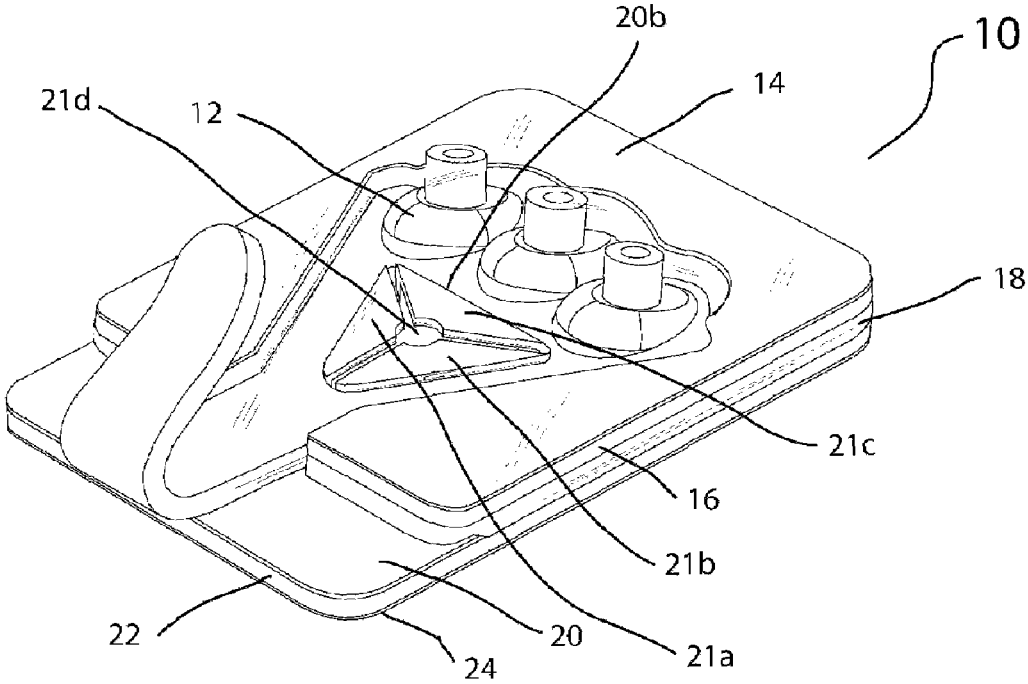
FIG. 2A shows a perspective view of the apparatus of FIG. 1 with the apparatus assembled.
Figure 2B:
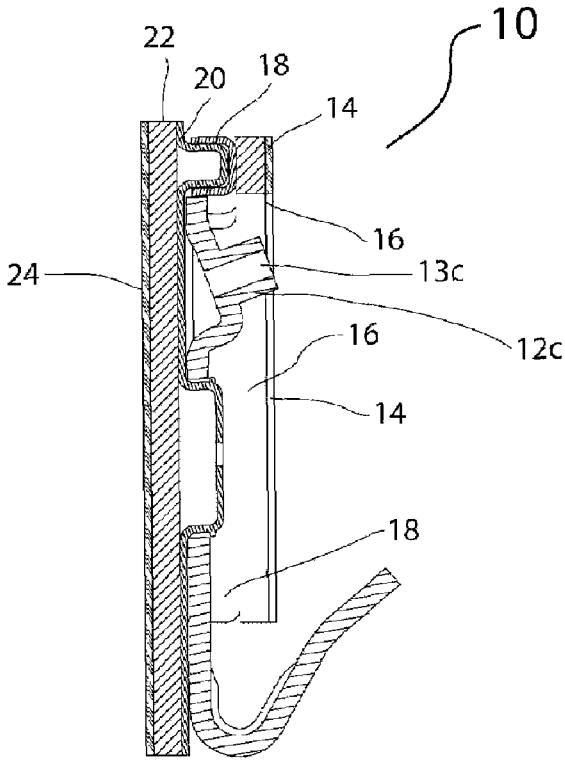
FIG. 2B shows a side cross sectional view of the apparatus of FIG. 1 with the apparatus assembled.

FIG. 1 shows a perspective view of an apparatus 10 in accordance with an embodiment of the present invention with the apparatus 10 shown taken apart. FIG. 2A shows a perspective view of the apparatus 10, with the apparatus 10 assembled. FIG. 2B shows a cross sectional view of the apparatus 10, with the apparatus 10 assembled.

The apparatus 10 is comprised of hanger 12, wax paper 14, a portion 16, an upper cap 18, a lower cap 20, a portion 22, and wax paper 24.

The hanger 12 can be made of metal. The hanger 12 has a hook portion 12*a*, a base portion 11*a*, a triangular opening 12*b*, and protrusions 12*c*, 12*d*, and 12*e*, having openings 13*c*, 13*d*, and 13*e*, respectively. Opening 13*c* of protrusion 12*c* is shown in FIG. 2B. The base portion 11*a* may be flat or substantially flat.

The wax paper 14 has an opening 14*a* into which the hanger 12 can be inserted. The portion 16 is comprised of a removable adhesive layer 16*a*, a foam tape 16*b*, and a permanent adhesive layer 16*c*. The portion 16 also has an opening 16*d* shown in FIG. 1, into which the hanger 12 can be inserted and snugly fit as shown in FIG. 2A. The base portion 11*a* of the hanger 12 can be inserted through the opening 14*a* and through the opening 16*d*, while the base portion 11*a* is parallel or substantially parallel to the wax paper 14, the opening 14*a*, the portion 16, and the opening 16*d*. The upper cap 18 has an opening 18*a* into which the hanger 12 can be inserted. The lower cap has a recess 20*a* shown in FIG. 1, into which the hanger 12 can be inserted as shown in FIG. 2A. The lower cap 20 has a triangular protrusion 20*b* which can be inserted into the opening 12*b* of the hanger 12.

The portion 22 is comprised of a permanent adhesive layer 22*a*, a foam tape 22*b*, and a removable adhesive layer 22*c*.

The wax paper 14 has an inner opening or slot 14*a* into which the metal hanger 12 snugly fits as shown by FIG. 2A. The portion 16 and the upper cap 18 have inner openings of slots 16*d* and 18*a* respectively, into which the metal hanger 12 snugly fits as shown by FIG. 2A. The lower cap 20 includes a recess 20*a* into which the metal hanger 12 snugly fits as shown by FIG. 2A. The lower cap 20 also includes a substantially triangular portion or protrusion 20*b*. The substantially triangular portion 20*b* may be of a type similar to that used for holding DVDs. The portion or protrusion 20*b* fits into the triangular portion 12*b* in order to hold the hanger 12 onto the lower cap 20. The substantially triangular portion 20*b* includes sections 21*a*, 21 *b*, and 21*c* and central opening 21*d*.

Figure 2C:
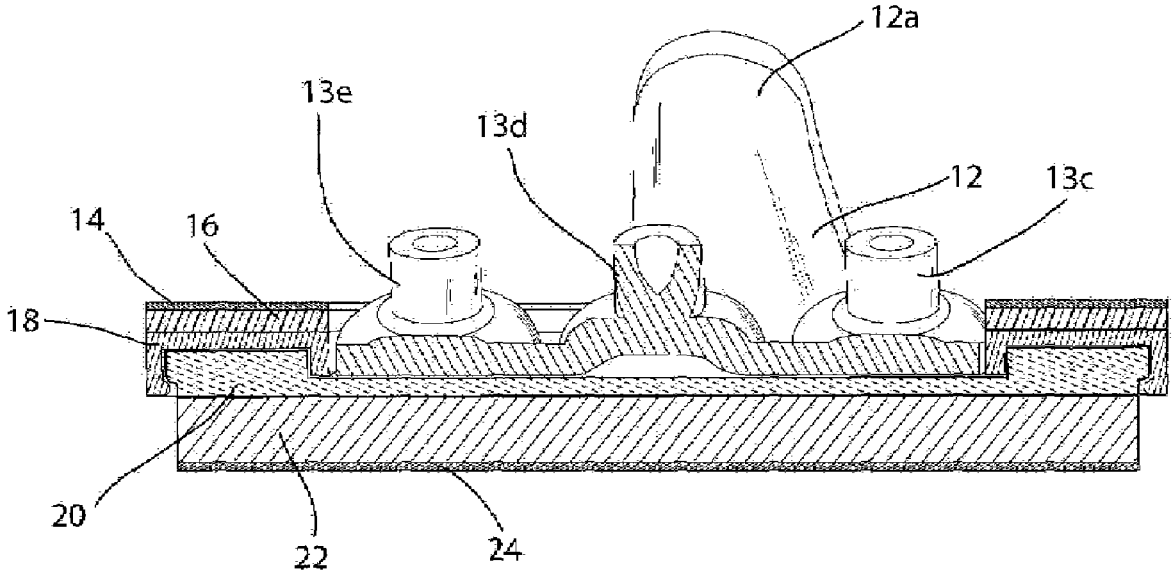
FIG. 2C shows a rear partial cross sectional view and a partial rear view of the apparatus of FIG. 1 with the apparatus assembled.

FIG. 2C shows a rear partial cross sectional view and a partial rear view of the apparatus 10 with the apparatus assembled. In FIG. 2C the hook portion 12*a* of the hook is shown. In addition the wax paper 14, portion 16, upper cap 18, lower cap 20, portion 22, and waxpaper 24 is shown in FIG. 2C. FIG. 2C also shows that the protrusions 13*e* and 13*c* are in line but are not in line with the protrusion 13*d*.

Figure 3A:
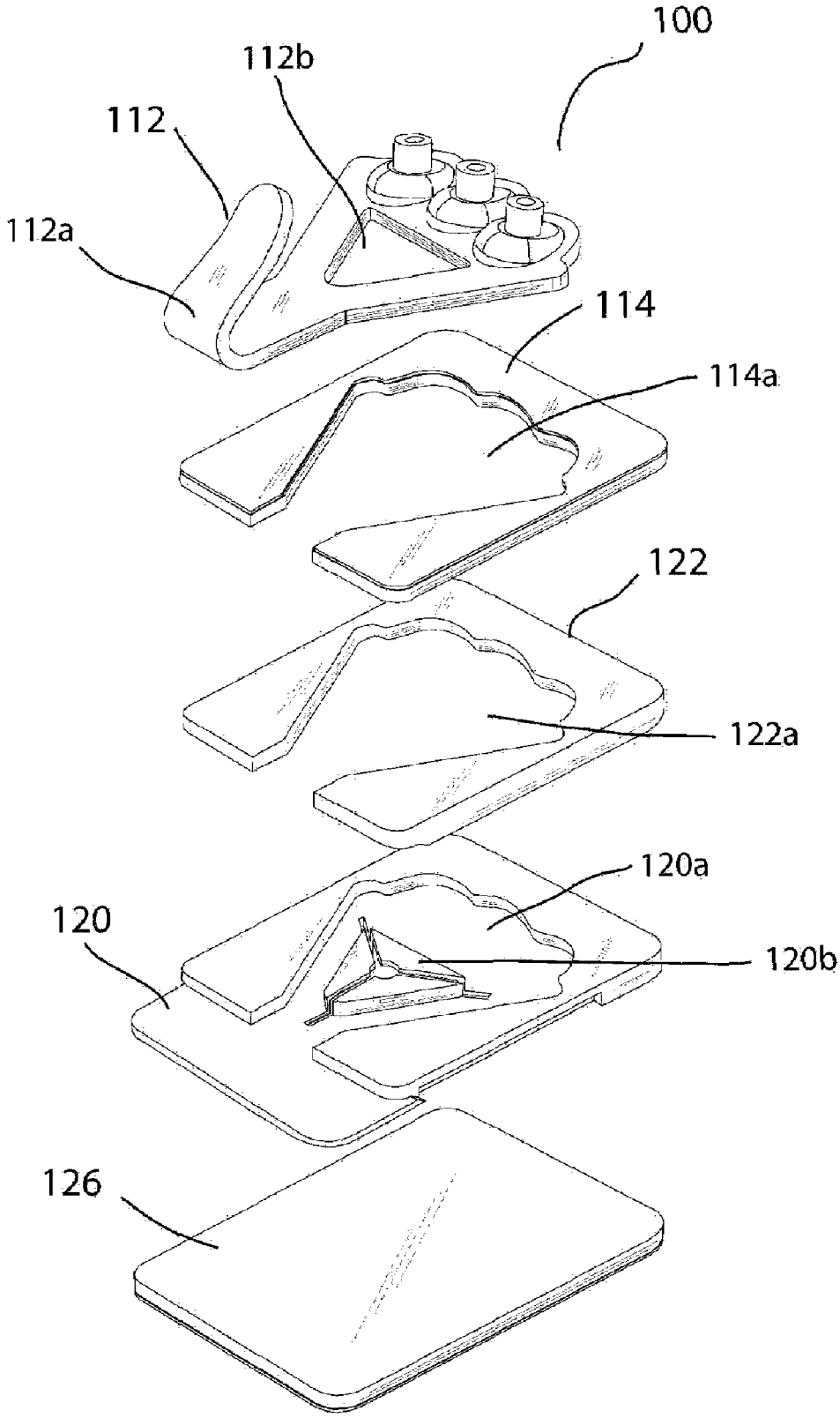
FIG. 3A shows a perspective view of a second apparatus in accordance with another embodiment of the present invention with the second apparatus shown taken apart.
Figure 3B:
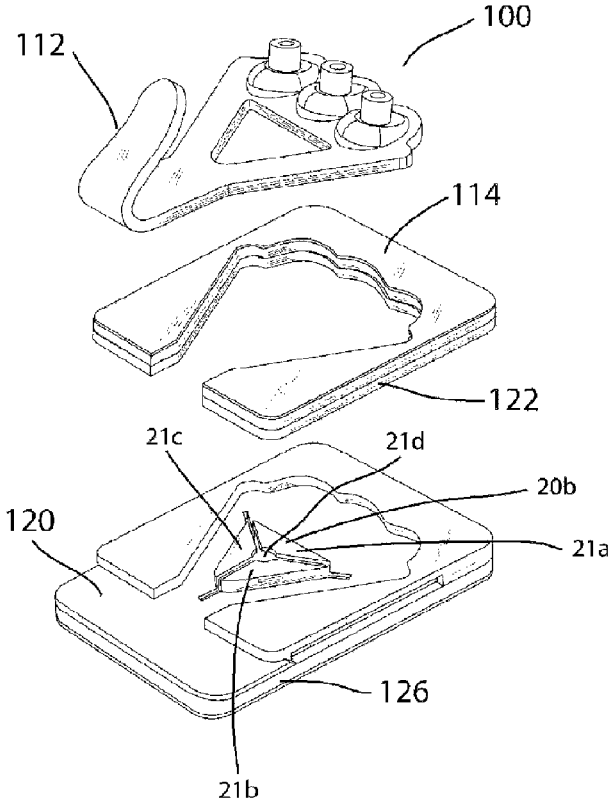
FIG. 3B shows a perspective view of the apparatus of FIG. 3A with the apparatus shown partially put together.
Figure 3C:
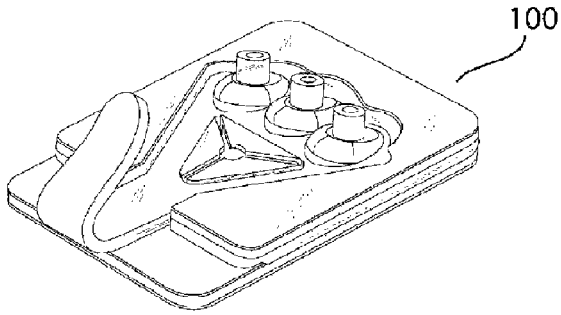
FIG. 3C shows a perspective view of the apparatus of FIG. 3A with the apparatus assembled.

FIG. 3A shows a perspective view of an apparatus 100 in accordance with another embodiment of the present invention with the apparatus 100 shown taken apart. FIG. 3B shows a perspective view of the apparatus 100 of FIG. 3A with the apparatus 100 shown partially put together. FIG. 3C shows a perspective view of the apparatus 100 of FIG. 3A with the apparatus 100 assembled.

The apparatus 100 is comprised of hanger 112, portion 114, an upper cap 122, a lower cap 120, and portion a 126. The hanger 112 may include a hook 112*a* and a triangular opening 112*b*, and may be identical to hanger 12 of FIG. 1. The portion 114 may have an inner opening or slot 114*a* into which the hanger 112 can be snugly inserted as shown in FIG. 3C. The portion 122 has an inner opening or slot 122*a* into which the hanger 112 can be snugly inserted as shown in FIG. 3C. The portion 120 has a recess 120*a* and an inner protrusion 120*b* (marked in FIG. 3A). The metal hanger 112 can be inserted into the recess 120*a* so that the inner protrusion 120*b* is inserted through the opening 112*b* in the hanger 112.

Figure 4A:
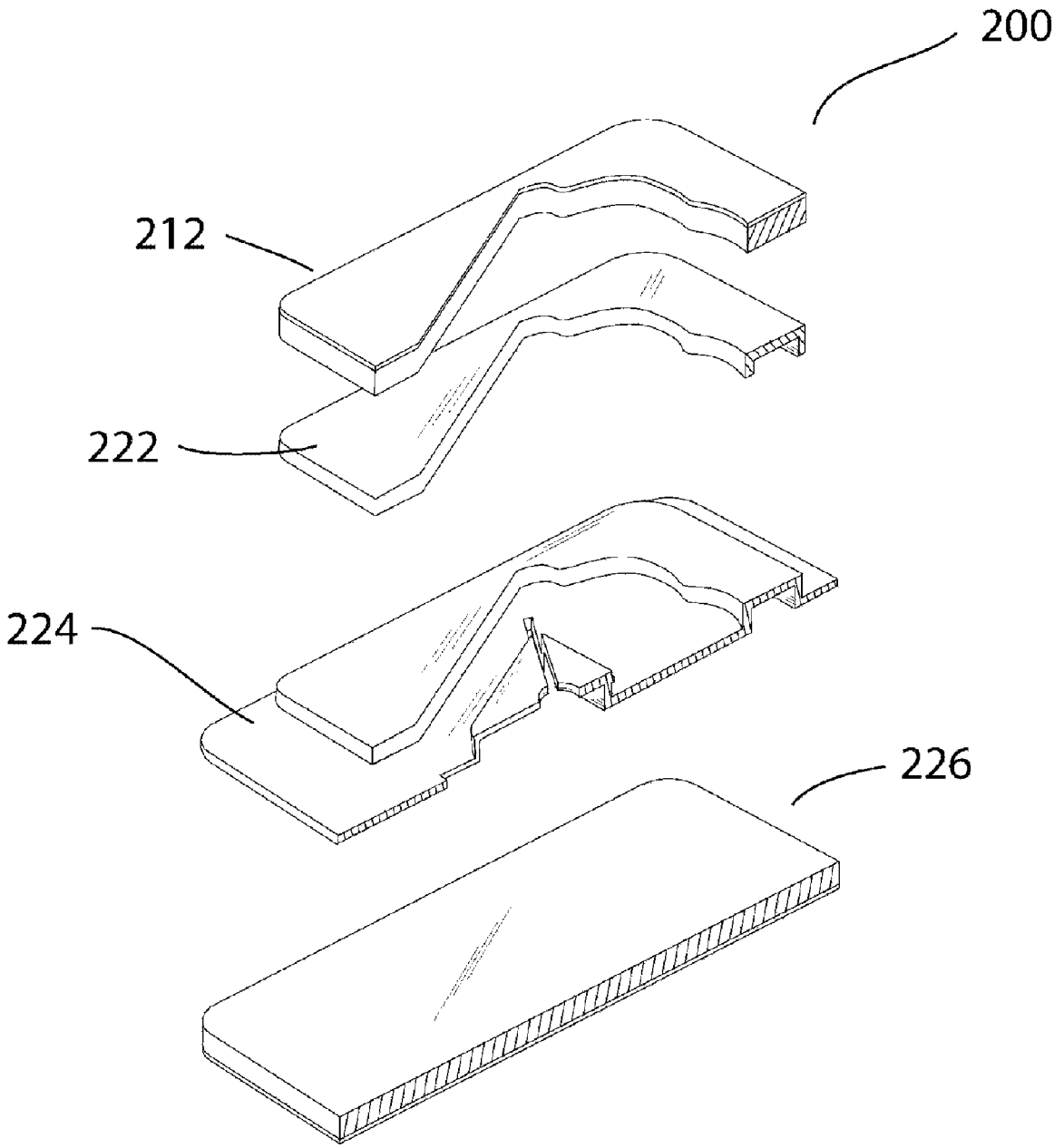
FIG. 4A shows a perspective view of a third apparatus in accordance with another embodiment of the present invention with the third apparatus shown taken apart.
Figure 4B:
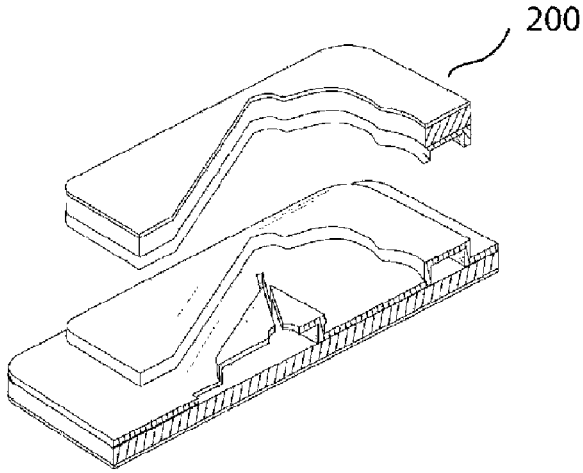
FIG. 4B shows a perspective view of the apparatus of FIG. 4A with the apparatus shown partially put together.
Figure 4C:
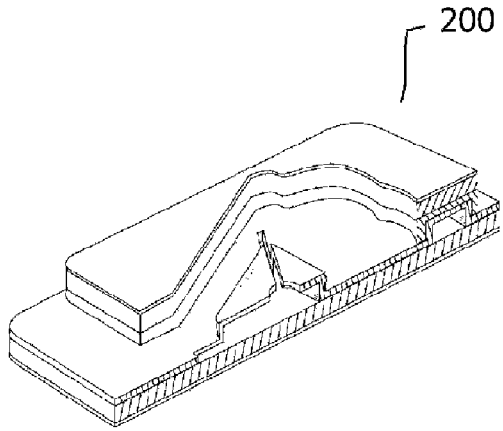
FIG. 4C shows a perspective view of the apparatus of FIG. 4A with the apparatus assembled.

FIG. 4A shows a perspective view of an apparatus 200 in accordance with another embodiment of the present invention with the apparatus 200 shown taken apart. FIG. 4B shows a perspective view of the apparatus 200, with the apparatus 200 shown partially put together. FIG. 4C shows a perspective view of the apparatus 200 with the apparatus assembled.

The apparatus 200 is comprised of portion 212, an upper cap 222, a lower cap 224, and a portion 226. The portion 212 may be comprised of wax paper, similar to 14 in FIG. 1 and foam tape, similar to 16 in FIG. 1. Wax paper 14 is for protecting the adhesive layer 16*a* of the foam tape 16 from exposing to the outside. The adhesive layer 16*a* is a temporary or removable adhesive layer and 16*c* is a permanent adhesive layer so the portion 212 is adhered permanently to upper cap 222. The temporary adhesive layer 16*a* is used for easier removal of portions 212 and upper cap 222 from a wall after a metal hanger, such as 12 is firmly nailed on a wall. Same theory is applied to lower cap 224 and portion 226, except they are to be removed from the picture frames.

Figure 5A:
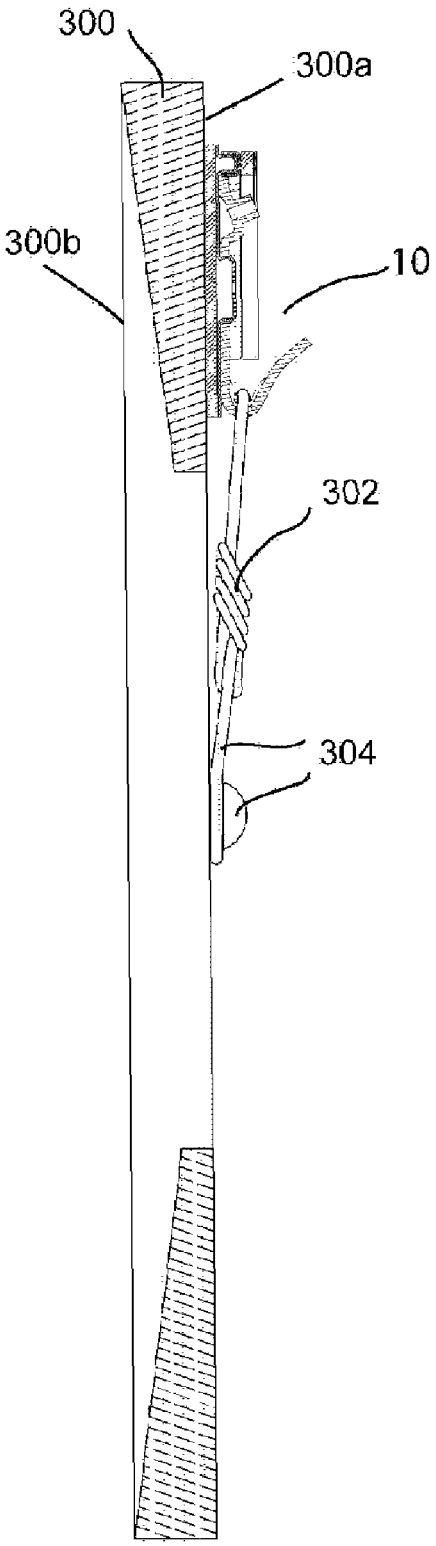
FIG. 5A is a cross sectional view of a picture frame, the apparatus of FIG. 1, a wire, and a wood frame hanger in a first state.
Figure 5B:
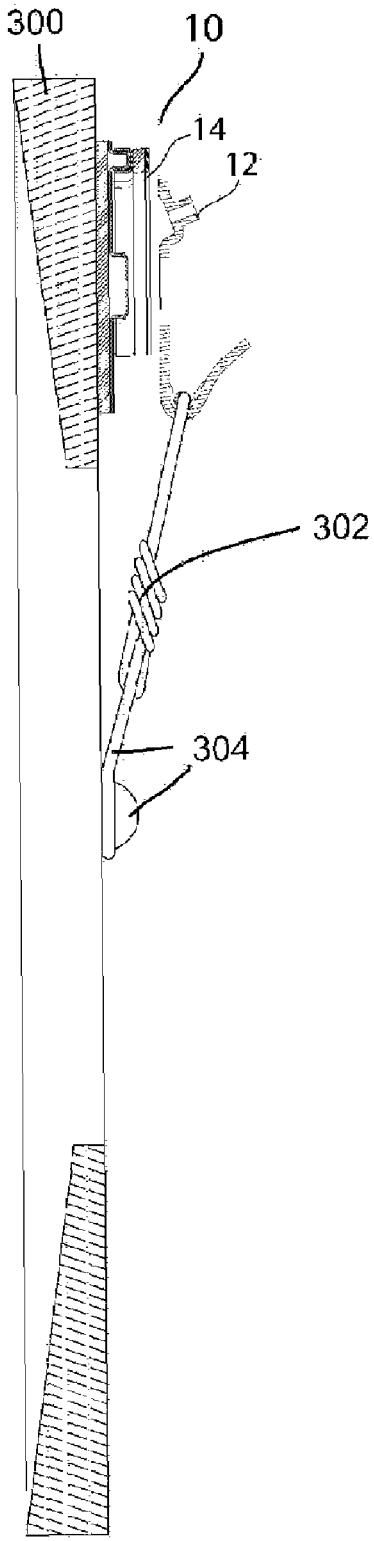
FIG. 5B is a cross sectional view of the picture frame, the apparatus of FIG. 1, the wire, and the wood frame hanger in a second state.
Figure 5C:
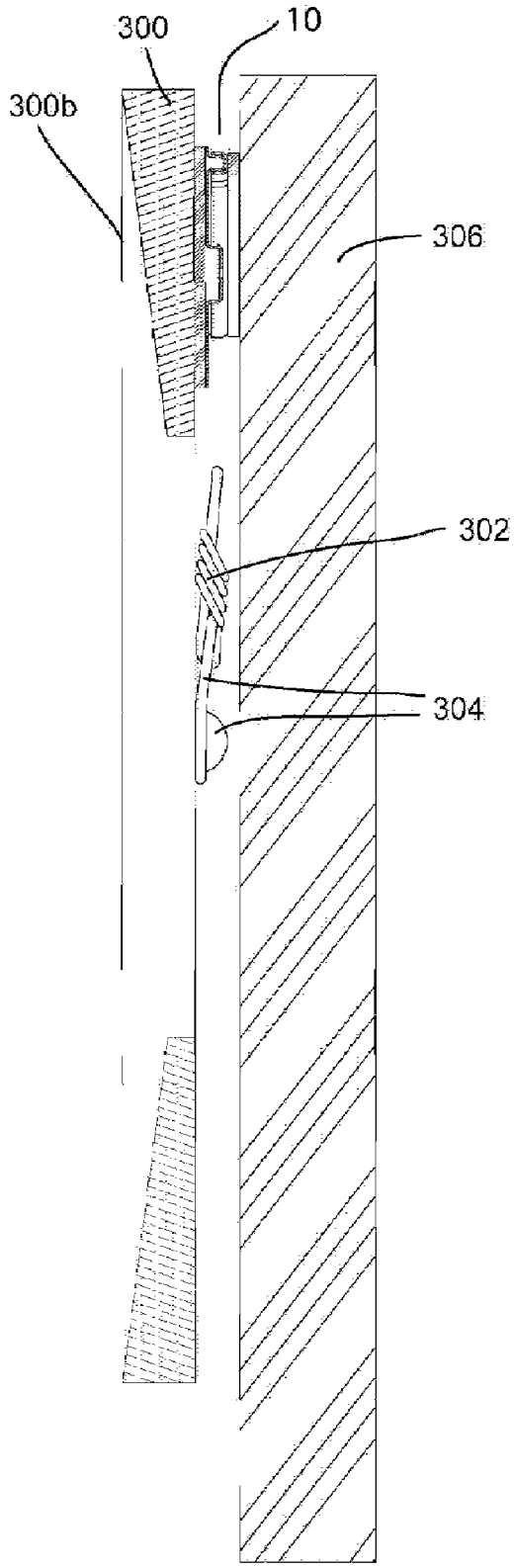
FIG. 5C is a cross sectional view of the picture frame, part of the apparatus of FIG. 1, the wire, the wood frame hanger in a third state, and a wall.

FIG. 5A is a cross sectional view of a picture frame 300, the apparatus or positioner 10 of FIG. 1, a wire 302, fastened on a metal wood frame hanger 304 attached to the picture frame 300 in a first state. FIG. 5B is a cross sectional view of the picture frame 300, the apparatus 10 of FIG. 1, the wire 302, and the wood frame hanger 304 in a second state. FIG. 5C is a cross sectional view of the picture frame 300, part of the apparatus 10 of FIG. 1, the wire 302, the wood frame hanger 304 in a third state, and a wall 306.

Figure 5D:
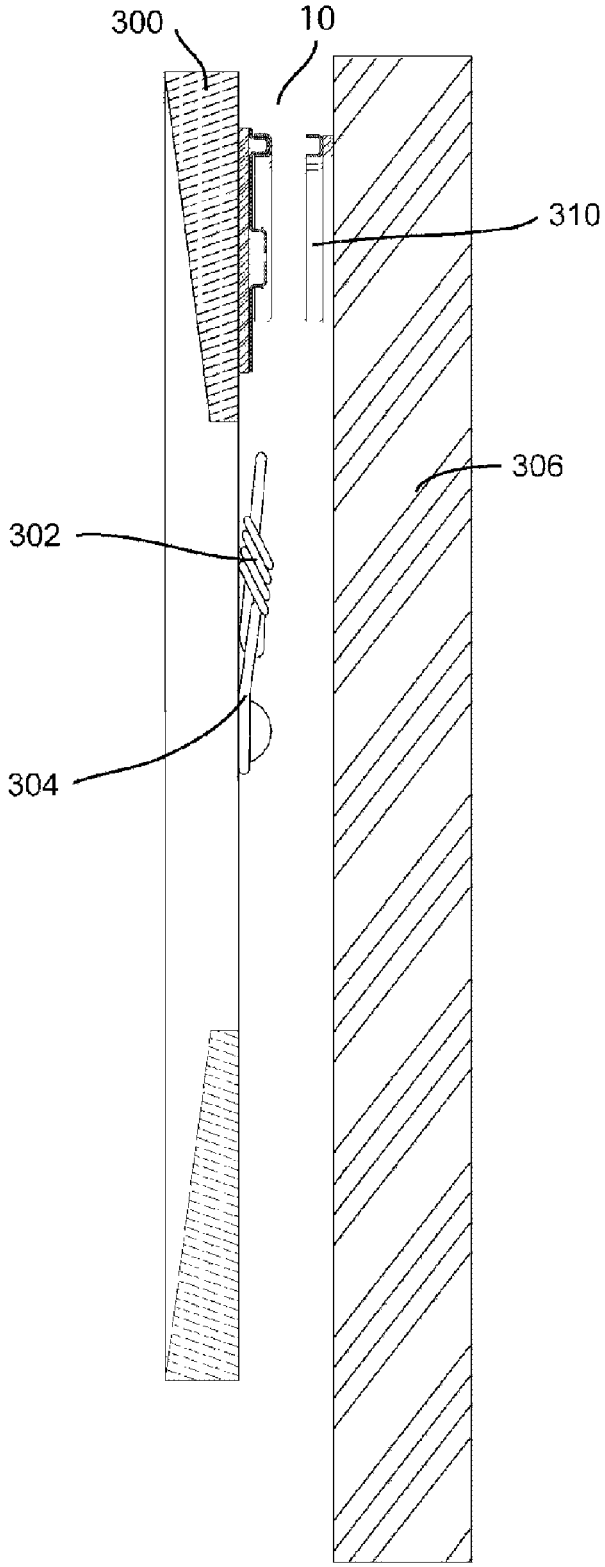
FIG. 5D is a cross sectional view of the picture frame, part of the apparatus of FIG. 1, the wire, the wood frame hanger in a fourth state and a wall.
Figure 5E:
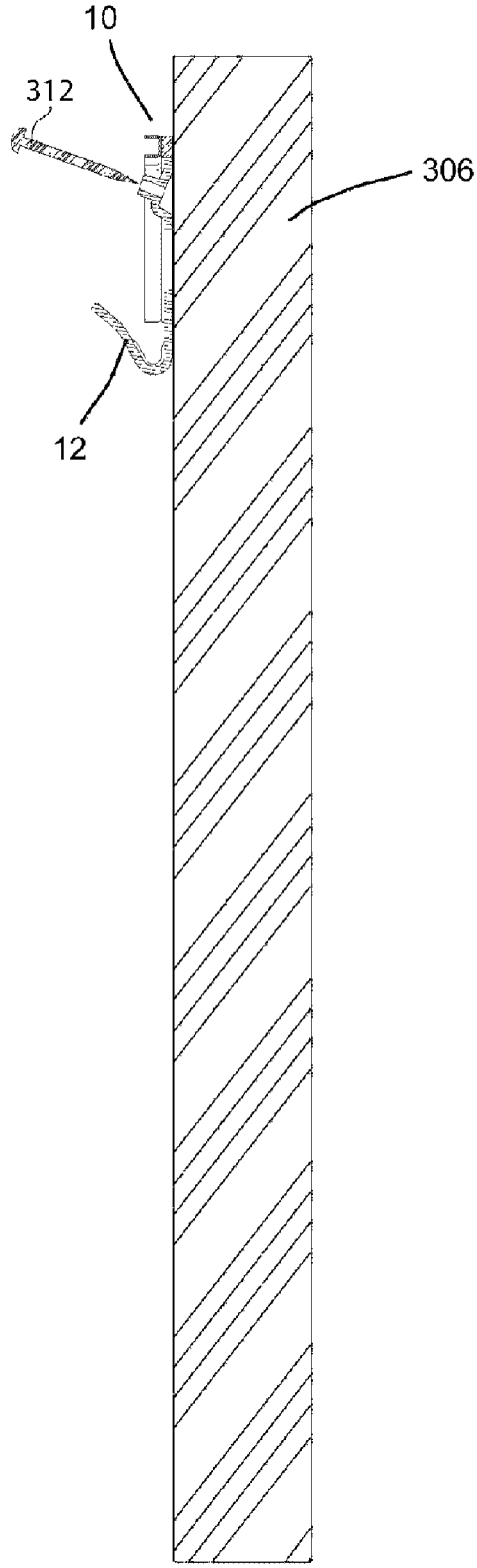
FIG. 5E is a cross sectional view of part of the apparatus of FIG. 1 and a nail in a fifth state, and the wall.
Figure 5F:
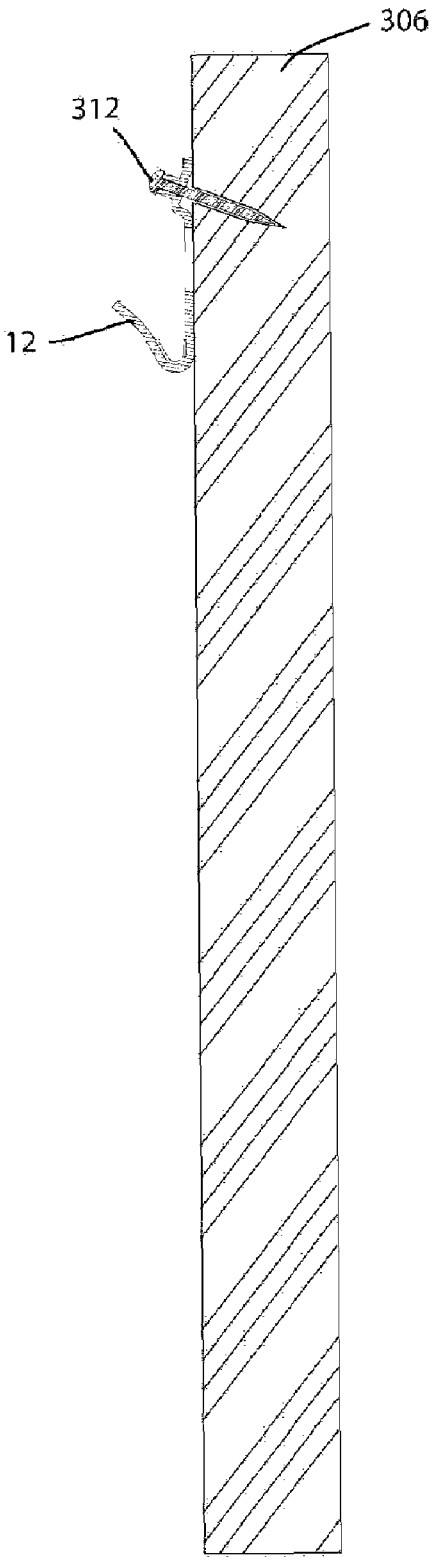
FIG. 5F is a cross sectional view of part of the apparatus of FIG. 1 and a nail in a sixth state, and the wall.
Figure 5G:
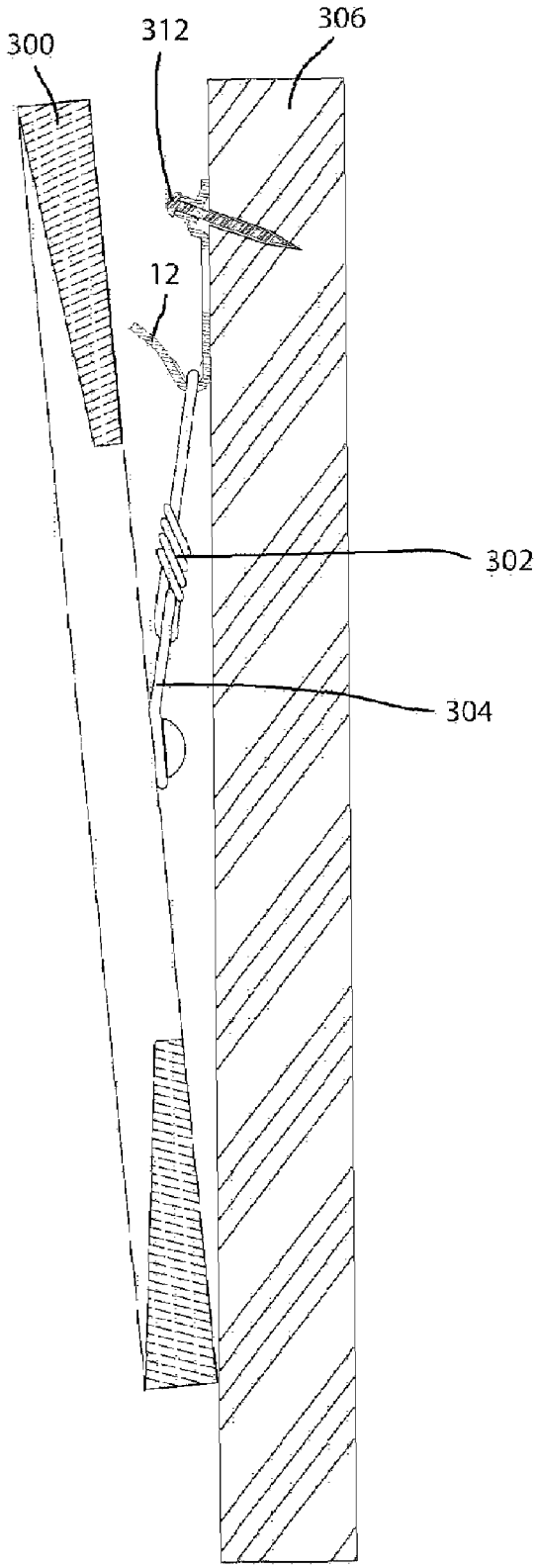
FIG. 5G is a cross sectional view of the picture frame, part of the apparatus of FIG. 1, the wire, the nail, and the wood frame hanger in a seventh state, and the wall.

FIG. 5D is a cross sectional view of the picture frame 300, part of the apparatus 10 of FIG. 1, the wire 302, the wood frame hanger 304 in a fourth state and a wall 306. FIG. 5E is a cross sectional view of part of the apparatus 10 of FIG. 1 and a nail 312 in a fifth state, and the wall 306. FIG. 5F is a cross sectional view of the part of the apparatus 10 of FIG. 1 and a nail 312 in a sixth state, and the wall 306. FIG. 5G is a cross sectional view of the picture frame 300, part of the apparatus 10 of FIG. 1, the wire 302, the nail 312, and the wood frame hanger 304 in a seventh state, and the wall 306.

In operation, with the wax paper 24 removed from the foam tape 22, of the apparatus 10 or positioner 10, the middle of the frame 300 is located and the apparatus 10 is hooked onto the wire 302 and adhered onto a back 300*a* of the frame 300 as shown as FIG. 5A. The metal hanger 12 is detached from the apparatus or positioner 10, along with a wire 302 and the wax paper 14 on the temporary adhesive 16 as shown in FIG. 5B. With the hanger 12 removed from the wire 302, the frame 300 is positioned and an individual presses down on the front 300*b* of the frame 300 so as to let the upper cap 18 adhere to the wall 306, as shown in FIG. 5C. Next the upper cap 18 is disengaged from the lower cap 20, as shown in FIG. 5D. Next the hanger 12 is put back into the upper cap 18 (mounted on a wall) so its position is defined as shown in FIG. 5E. A nail 312 is applied as shown in FIG. 5E. The upper cap 18 is removed from the wall after the hanger 12 is nailed on the wall as shown in FIG. 5F. Finally the picture frame 300, with the lower cap 20 removed, is hung back on the wall 306 as shown in FIG. 5G.

The hangers 12 can be made of metal or another material. The hangers 12 can be of different shapes.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

What is claimed is:

1. An apparatus comprising:

a J-shaped hanger including a hook and a base, the hook connected to the base, the base forming a substantially flat vertical portion of the J-shape, the hook forming the hook portion of the J-shape;

a first device;

wherein the first device has a first portion having an opening which is large enough so that the base can pass through the opening of the first portion while the base is substantially parallel to the first device;

wherein the first device has a front with a first temporary adhesive and a back with a second temporary adhesive;

wherein the base of the J-shaped hanger including an opening;

and wherein the first device including lower cap portion having protrusion which can be inserted into the opening of the J-shaped hanger and which snaps into the opening of the base of the J-shaped hanger to hold the J-shaped hanger to the lower cap portion of the first device.

2. The apparatus of claim 1 wherein the base of the J-shaped hanger has attached thereto a plurality of protrusions each having an opening through which a nail can be driven.

3. The apparatus of claim 1 wherein the first portion is an upper cap portion which can be engaged or disengaged from the lower cap portion.

4. The apparatus of claim 3 further comprising a second portion comprised of a cushion layer and the front with the first temporary adhesive.

5. The apparatus of claim 4 further comprising a third portion comprised of a cushion layer and the back with the second temporary adhesive.

6. The apparatus of claim 5 wherein the third portion has an opening which is large enough so that the base can pass through the opening of the third portion while the base is substantially parallel to the first device.

7. The apparatus of claim 6 wherein when the lower cap portion is engaged with the upper cap portion, the lower cap portion lies between the second portion and the upper cap portion, and the upper cap portion lies between the lower cap portion and the third portion.

8. A method including pulling a wire of a picture frame up with a J-shaped hanger of an apparatus;

attaching the apparatus including the J-shaped hanger to a back of the picture frame, so that the wire is tensed;

wherein the apparatus includes a J-shaped hanger including a hook and a base, the hook connected to the base, the base forming a substantially flat vertical portion of the J-shape, the hook forming the hook portion of the J-shape;

a first device;

wherein the first device has a first portion having an opening which is large enough so that the base can pass through the opening of the first portion while the base is substantially parallel to the first device; and wherein the first device has a front with a first temporary adhesive and a back with a second temporary adhesive;

and wherein the apparatus is attached to the picture frame by attaching the first temporary adhesive to the back of the picture frame;

and further comprising detaching the J-shaped hanger from the rest of the apparatus;

attaching the second temporary adhesive to a wall to attach a first portion of the apparatus to the wall;

inserting the J-shaped hanger into the first portion of the apparatus; and fastening the J-shaped hanger to the wall;

wherein the base of the J-shaped having includes an opening;

and wherein the first device includes lower cap portion having protrusion which can be inserted into the opening of the J-shaped hanger and which into the opening of the base of the J-shaped hanger to hold the J-shaped hanger to the lower cap portion of the first device.

9. The method of claim 8
further comprising
detaching any remaining portion of the apparatus from the wall, while leaving the J-shaped hanger fastened to the wall.

10. The method of claim 8 wherein
the base of the J-shaped hanger has attached thereto a plurality of protrusions each having an opening through which a nail can be driven.

11. The method of claim 8 wherein
the first portion is an upper cap portion;
and further comprising disengaging the upper cap portion from the lower cap portion.

12. The method of claim 11 wherein
the apparatus includes a second portion comprised of a cushion layer and the front with the first temporary adhesive.

13. The method of claim 12 wherein
the apparatus includes a third portion comprised of a cushion layer and the back with the second temporary adhesive.

14. The method of claim 13 wherein
the third portion has an opening which is large enough so that the base can pass through the opening of the third portion while the base is substantially parallel to the first device.

15. The method of claim 14 wherein
when the lower cap portion is engaged with the upper cap portion, the lower cap portion lies between the second portion and the upper cap portion, and the upper cap portion lies between the lower cap portion and the third portion.

* * * * *